US012655533B2

(12) United States Patent
Akolkar

(10) Patent No.: US 12,655,533 B2
(45) Date of Patent: Jun. 16, 2026

(54) SYSTEM AND PROCESS FOR SUSTAINABLE ELECTROWINNING OF METAL

(71) Applicant: CASE WESTERN RESERVE UNIVERSITY, Cleveland, OH (US)

(72) Inventor: Rohan Akolkar, Cleveland, OH (US)

(73) Assignee: CASE WESTERN RESERVE UNIVERSITY, Cleveland, OH (US)

( * ) Notice: Subject to any disclaimer, the term of this patent is extended or adjusted under 35 U.S.C. 154(b) by 562 days.

(21) Appl. No.: 18/054,277

(22) Filed: Nov. 10, 2022

(65) Prior Publication Data

US 2023/0279572 A1 Sep. 7, 2023

Related U.S. Application Data

(60) Provisional application No. 63/334,858, filed on Apr. 26, 2022.

(51) Int. Cl.

| | |
|---|---|
| ***C25C 3/00*** | (2006.01) |
| ***C25C 1/22*** | (2006.01) |
| ***C25C 7/02*** | (2006.01) |

(52) U.S. Cl.
CPC ..... *C25C 1/22* (2013.01); *C25C 7/025* (2013.01)

(58) Field of Classification Search
CPC ..... C25C 1/22; C25C 7/025
See application file for complete search history.

(56) References Cited

U.S. PATENT DOCUMENTS

| | | | | |
|---|---|---|---|---|
| 3,857,763 | A * | 12/1974 | Du Bois | C25C 1/22 134/41 |
| 4,400,247 | A | 8/1983 | Ginatta | |
| 4,440,610 | A | 4/1984 | Dawless et al. | |
| 5,089,094 | A * | 2/1992 | Ogasawara | C25C 3/04 423/178 |
| 5,683,559 | A | 11/1997 | De Nora | |
| 7,517,384 | B2 | 4/2009 | Marsden et al. | |
| 10,988,826 | B2 | 4/2021 | Liddell et al. | |
| 2006/0151326 | A1* | 7/2006 | Koizumi | G21C 19/46 205/43 |
| 2008/0110765 | A1* | 5/2008 | Ogasawara | C25C 3/34 205/560 |
| 2009/0294299 | A1* | 12/2009 | Mizuguchi | C25C 1/22 205/560 |
| 2010/0314260 | A1* | 12/2010 | Fujita | C25C 3/34 204/243.1 |
| 2016/0185597 | A1* | 6/2016 | Chaifetz | C01G 49/10 423/493 |

(Continued)

OTHER PUBLICATIONS

Alkolkar, Rohan, "Perspective—Is Sustainable Electrowinning of Neodymium Metal Achievable", Journal of the Electrochecmical Society, 2022 169 043501.

(Continued)

*Primary Examiner* — Zulmariam Mendez
(74) *Attorney, Agent, or Firm* — Tarolli, Sundheim, Covell & Tummino LLP

(57) ABSTRACT

A process for production of metal(s) by molten-salt electrolysis includes direct non-carbothermic chlorinating of ore containing metal oxide(s) to produce metal chloride(s); and electrolysis of molten salt(s) of the metal chloride(s) for electrowinning of metal(s) product.

14 Claims, 5 Drawing Sheets

(56) References Cited

U.S. PATENT DOCUMENTS

| | | | | |
|---|---|---|---|---|
| 2017/0183759 | A1* | 6/2017 | Cunningham | C25C 7/00 |
| 2017/0275732 | A1 | 9/2017 | Brewer | |

OTHER PUBLICATIONS

Arthur D. Little, "A Survey of Potential Processes for the Manufacture of Aluminum" Argonne National Laboratory, Argonne, Illinois, Dec. 1979.

Dai Shen, et al. "Electrodeposition of Neodymium from NdCl3-Containing Eutectic LiCI-KCI Melts Investigated Using Voltammetry and Diffusion-Reaction Modeling" Journal of the Electrochemical Society, 164 (8) H5292-H5298 (2017).

Joseph A. Rard, "Critical Evaluation of the Standard Molar Entropies, Enthalpies of Formation, Gibbs Energies of Formation and Heat Capacities of the Aqueous Trivalent Rare Earth Ions, and the Corresponding Standard Molar Entropies, Enthalpies of Formation and Gibbs Energies of Formation of the Thermodynamically Stable RECI 37H 2O (cr) and RECI 36H2 O(cr)" J. Solution Chem, Jun. 5, 2016.

* cited by examiner

SYSTEM AND PROCESS FOR SUSTAINABLE ELECTROWINNING OF METAL

RELATED APPLICATION

This application claims priority from U.S. Provisional Application No. 63/334,858, filed Apr. 26, 2022, the subject matter of which is incorporated herein by reference in its entirety.

GOVERNMENT FUNDING

This invention was made with government support under DE-EE0009434 awarded by the Department of Energy. The government has certain rights in the invention.

INTRODUCTION

Electrowinning is an important technology enabling the extraction of various metals from their ore bodies. Electrowinning using high temperature molten salt as the electrolyte medium has been practiced in industry for decades. Such high temperature molten salts possess low viscosity, high ionic conductivity and diffusivity, high solubility for electroactive species, electrochemical stability over a wide potential window, and very fast electrochemical kinetics. All these properties are highly desirable for energy efficient, selective and scalable industrial metal extraction processes. The electrowinning technology, referred to here also as 'molten salt electrolysis' (or MSE), is best exemplified by the Hall-Héroult process practiced globally for aluminum (Al) metal production. MSE processes have been investigated for other light metals, such as titanium (Ti) and magnesium (Mg) and for structural metals, such as iron (Fe), and some have even reached maturity for scale up to high volume metal production. MSE processes have also been the preferred route for commercial production of rare earth metals including neodymium (Nd). This rare earth metal has attracted great attention recently due to its rapidly growing demand fueled by technologically important applications, such as electrified transportation, renewable energy harvesting, and magnetic data storage. For example, neodymium-iron-boron (Nd—Fe—B) permanent magnets are critical to making electric motors for aforementioned applications.

From the viewpoint of sustainability, a major drawback of commercial MSE processes, particularly for high volume production of light metals (e.g., Al) and relatively low volume production of rare earth metals (e.g., Nd) is that they cause greenhouse gas emissions. In Al production, the overall reaction is: $2\ Al_2O_{3(ore)}+3\ C_{(anode)} \rightarrow 4\ Al_{(metal)}+3\ CO_{2(gas)}$. In 2021, about 67 million metric tons of primary Al was produced, corresponding to 82 million metric tons of $CO_2$ emitted directly just from the MSE operation. Similarly, during MSE for Nd metal production, $CO_2$ is generated via the reaction: $2\ Nd_2O_{3(ore)}+3\ C_{(anode)} \rightarrow 4\ Nd_{(metal)}+3\ CO_{2(gas)}$. Annual production of about 30 thousand tonnes of primary Nd results in emission of about 7 thousand tonnes of direct $CO_2$. At present, this rate of $CO_2$ emission from MSE of Nd is small in comparison to that from Al production, and negligible in relation to non-electrochemical metal production processes, such as the carbothermic reduction of iron ore to iron in a blast furnace. However, the push towards a clean energy economy will almost certainly result in an exponential rise in the demand for Nd metal in the coming decades, which will result in a proportional increase in $CO_2$ emissions associated with Nd electrowinning. In addition to $CO_2$, MSE processes for Al and Nd also generate perfluorocarbons (PFCs) via the reaction between the graphite anode and the fluoride-containing electrolyte. PFCs are potent greenhouse gases too with very high global warming potentials. Accordingly, the conventional fluoride-based molten salt electrolysis route for neodymium and other rare earth metal production is not attractive from a sustainability point-of-view because of harmful $CO_2$ and perfluorocarbon gas emissions and the energy-intensive nature of this process.

SUMMARY

Embodiments described herein relate to a system and process for the production, extraction, or recovery of metal(s) by electrowinning and, particularly, relates to a sustainable system and process for the production, extraction, or recovery of metal(s) from a metal bearing material containing a metal oxide using non-carbothermic chlorination and molten salt electrolysis (MSE). The process includes reacting a metal oxide with HCl in a non-carbothermic reaction to generate an aqueous solution that includes a metal chloride. The metal chloride is then dried, combined with a chloride based molten salt electrolyte, and subjected to chloride molten salt electrolysis. Chloride molten salt electrolysis of the metal chloride can provide high-efficiency electrowinning of solid metal or liquid metal while evolving chlorine ($Cl_2$) gas. The metal produced by molten salt electrolysis can be recovered and the $Cl_2$ gas can optionally be recycled in a chlorination process with $H_2$ generated by electrolysis of water formed during the non-carbothermic electrolysis of the metal oxide. The chloride molten salt electrolysis can enable the use of a non-consumable or dimensionally stable anode, which can potentially lead to reduced energy consumption, stable electrochemical cell operation, and ease of process scalability.

In some embodiments, a system for production of metal(s) from a metal ore containing a metal oxide can include a chlorination reactor configured for non-carbothermic chlorination of ore containing metal oxide to metal chloride(s) and a molten salt electrolysis reactor configured for molten salt electrolysis of the metal chloride(s) to metal and chlorine gas. Optionally, the system can include a reactor for converting the chlorine gas generated in the electrolysis reactor to HCl. Optionally, the HCl can be transferred to the chlorination reactor for non-carbothermic chlorination of the metal oxide.

In some embodiments, the system further includes a means for separating the metal from the molten salt, wherein the metal is in solid or liquid form.

In some embodiments, the chlorination reactor includes HCl converted from the generated chlorine gas at a molarity effective to convert the metal oxide to metal chloride(s).

In some embodiments, the ore comprises an oxide of at least one of Nd, Dy, Pr, La, Ce, or Fe.

In some embodiments, the electrolysis reactor includes an electrochemical cell. The electrochemical cell can include an anode and cathode provided in a chloride based molten salt electrolyte.

In some embodiments, the anode can be non-consumable and/or dimensionally stable during electrolysis. For example, the non-consumable and/or dimensionally stable anode can include at least one of titanium or graphite optionally coated with a mixed-metal oxide, where the mixed metal oxide comprises $RuO_2$, $IrO_2$ or their combination.

In other embodiments, the cathode can include an inert metal, such as tungsten or molybdenum.

In some embodiments, the molten salt electrolysis reactor is configured for moderate temperature molten salt electrolysis in, for example, a batch reactor, to facilitate electrowinning of a solid metal on the cathode. The molten salt electrolyte used for moderate temperature molten salt electrolysis can include a eutectic of at least two of LiCl, KCl, NaCl, CsCl, $MgCl_2$, $SrCl_2$, $BaCl_2$ or $CaCl_2$). The moderate temperature molten salt electrolysis can be conducted at a temperature of about 400° C. to about 800° C.

In some embodiments, the anode and cathode are separated from one another in the electrochemical cell, such as an electrochemical cell of a batch molten salt electrolysis reactor.

In other embodiments, the electrochemical cell further includes a porous separator or diaphragm positioned between and separating the anode and cathode. The separator or diaphragm can inhibit redox shuttling and back reaction between metal plated on the cathode and chlorine gas generated at the anode. The separator or diaphragm can include, for example, a ceramic with a porosity of about 10% to about 60%.

In some embodiments, the molten salt electrolysis reactor includes at least one bipolar electrode having a cathode first surface and an opposite anode surface.

In other embodiments, the molten salt electrolysis reactor includes a plurality of bipolar electrodes.

In some embodiments, the bipolar electrode(s) can include graphite electrodes. The graphite electrodes can be arranged in at least one stack.

In some embodiments, the molten electrolysis reactor is configured for batch, semi-continuous, or continuous molten salt electrolysis.

In other embodiments, the molten salt electrolysis reactor is configured for high temperature molten salt electrolysis to facilitate electrowinning of a liquid or molten metal on the cathode that can flow from the cathode and accumulate in the molten salt electrolysis reactor. The accumulated metal can be removed periodically or continuously from the molten salt electrolysis reactor. The molten salt electrolyte used for high temperature molten salt electrolysis can include a eutectic of $SrCl_2$, $BaCl_2$, and optionally at least one of LiCl, KCl, NaCl, CsCl, $MgCl_2$, or $CaCl_2$). The high temperature molten salt electrolysis can be conducted at a temperature of at least about 800° C.

In some embodiments, the system includes a current source for supplying a current to the electrodes at a current density effective for molten salt electrolysis of the metal chloride(s) to metal and chlorine gas. The current density effective for electrolysis can be, for example, about 50 $mA/cm^2$ to about 1 $A/cm^2$.

In some embodiments, the ore can include a rare earth metal oxide, such as neodymium oxide, e.g., $Nd_2O_3$.

In some embodiments, the system produces substantially no $CO_2$ or perfluorocarbon emissions during operation.

Other embodiments described herein relate to a process for the production of metal(s) by molten-salt electrolysis. The process can include non-carbothermic chlorinating an ore containing metal oxide to metal chloride(s) and electrolyzing the metal chloride(s) by chloride molten salt electrolysis to metal and chlorine gas. Optionally, the chlorine gas generated by chloride molten salt electrolysis can be converted to HCl and used in the non-carbothermic chlorination of the metal oxide.

In some embodiments, the process further includes separating the metal from the molten salt, wherein the metal is in solid or liquid form.

In some embodiments, the HCl converted from the generated chlorine gas is provided at molarity effective to convert the metal oxide to metal chloride(s).

In some embodiments, the ore comprises an oxide of at least one of Nd, Dy, Pr, La, Ce, or Fe.

In some embodiments, the molten salt electrolysis can be performed in an electrochemical cell. The electrochemical cell includes an anode and cathode provided in a molten salt. The anode can be non-consumable and/or dimensionally stable during electrolysis. For example, the non-consumable and/or dimensionally stable anode can include at least one of titanium or graphite optionally coated with a mixed-metal oxide.

In other embodiments, the cathode includes an inert metal, such as tungsten or molybdenum.

In some embodiments, the molten salt electrolysis can be performed at a moderate temperature in, for example, a batch reactor, to facilitate electrowinning of a solid metal on the cathode. The molten salt electrolyte used for moderate temperature molten salt electrolysis can include a eutectic of at least two of LiCl, KCl, NaCl, CsCl, $MgCl_2$, $SrCl_2$, $BaCl_2$ or $CaCl_2$. The moderate temperature molten salt electrolysis can be conducted at a temperature of about 400° C. to about 800° C.

In some embodiments, the electrolysis reactor includes at least one bipolar electrode having a cathode first surface and an opposite anode surface.

In other embodiments, the electrolysis reactor includes a plurality of bipolar electrodes.

In some embodiments, the bipolar electrode(s) can include graphite electrodes. The graphite electrodes can be arranged in at least one stack.

In some embodiments, the molten salt electrolysis can include batch, semi-continuous, or continuous molten salt electrolysis.

In other embodiments, the molten salt electrolysis reactor can be performed at a high temperature to facilitate electrowinning of a liquid or molten metal on the cathode that can flow from the cathode and accumulate in the molten salt electrolysis reactor. The accumulated metal can removed periodically or continuously from the molten salt electrolysis reactor. The molten salt electrolyte used for high temperature molten salt electrolysis can include a eutectic of $SrCl_2$, $BaCl_2$, and optionally at least one of LiCl, KCl, NaCl, CsCl, $MgCl_2$, or $CaCl_2$. The high temperature molten salt electrolysis can be conducted at a temperature of at least about 800° C.

In some embodiments, the molten salt electrolysis can be performed at a current density of, for example, about 50 $mA/cm^2$ to about 1 $A/cm^2$.

In some embodiments, the ore can include a rare earth metal oxide, such as neodymium oxide, e.g., $Nd_2O_3$.

In some embodiments, the process produces substantially no $CO_2$ or perfluorocarbon emissions during operation.

DETAILED DESCRIPTION

Embodiments described herein relate to a system and process for the production, extraction, or recovery of metal(s) by electrowinning and, particularly, relates to a sustainable system and process for the production, extraction, or recovery of metal(s) from a metal bearing material containing a metal oxide using non-carbothermic chlorination and chloride molten salt electrolysis. As illustrated in the flow diagram of FIG. 1, the process includes reacting a metal oxide with HCl in a non-carbothermic reaction to generate an aqueous solution that includes a metal chloride. The metal chloride is then dried, combined with a chloride based molten salt electrolyte, and subjected to chloride molten salt electrolysis. Chloride molten salt electrolysis of the metal chloride can provide high-efficiency electrowinning of solid metal or liquid metal while evolving chlorine ($Cl_2$) gas. The metal produced by molten salt electrolysis can be recovered and the $Cl_2$ gas can optionally be recycled in a chlorination process with $H_2$ generated by electrolysis of water formed during the non-carbothermic electrolysis of the metal oxide. The chloride molten salt electrolysis can enable the use of a non-consumable or dimensionally stable anode, which can potentially lead to reduced energy consumption, stable electrochemical cell operation, and ease of process scalability.

Figure 1:
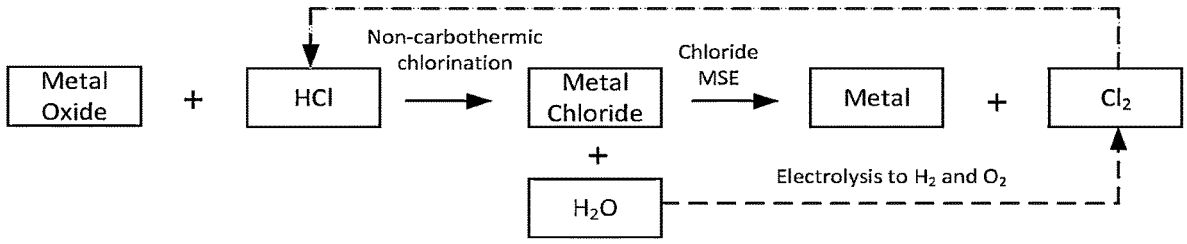
FIG. 1 illustrates a schematic flow diagram of a sustainable process for the production, extraction, or recovery of metal(s) from a metal bearing material containing a metal oxide.
Figure 2:
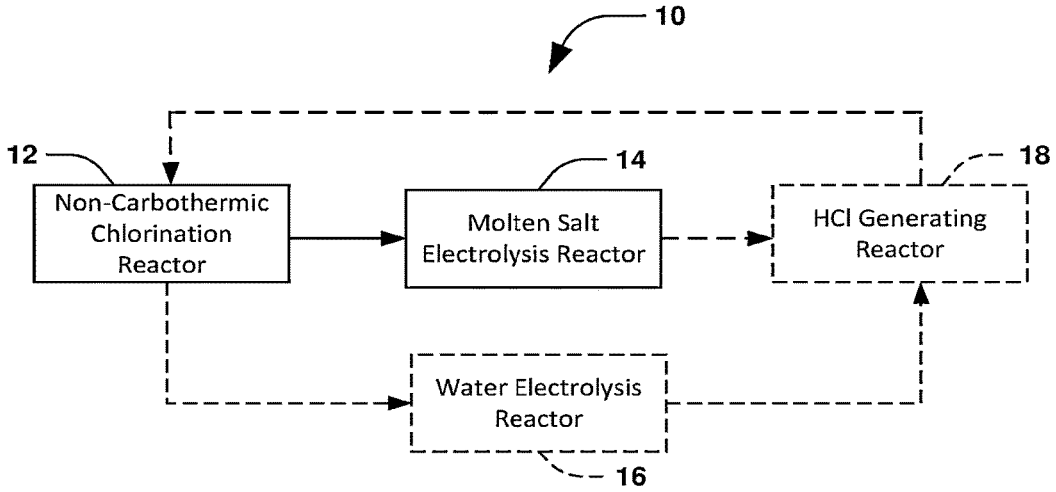
FIG. 2 illustrates a schematic diagram of a system for performing the non-carbothermic chlorination and molten salt electrolysis of FIG. 1.

Referring to FIG. 2, the process of FIG. 1 can generally be performed using a system 10 that includes a non-carbothermic chlorination reactor 12 configured for non-carbothermic chlorination of ore containing metal oxide to metal chloride(s) and a molten salt electrolysis reactor 14 configured for chloride molten salt electrolysis of the metal chloride(s) to metal and chlorine gas. Optionally, the system 10 can include water electrolysis reactor 16 for generating $H_2$ from water formed during the non-carbothermic chlorination of the metal oxide to metal chloride and an HCl generating reactor 18 for converting $Cl_2$ gas generated in the molten salt electrolysis reactor 14 and $H_2$ generated by electrolysis of water to HCl. The HCl generated can be optionally transferred to the non-carbothermic chlorination reactor 12 at a molarity effective for non-carbothermic chlorination of metal oxide.

The non-carbothermic chlorination reactor 12, molten salt electrolysis reactor 14, and optional water electrolysis reactor 16, and optional HCl generating reactor 18 can be integrated, connected, coupled, or in communication such that products formed in each respective reactors, 12, 14, 16, 18, including metal chloride, water, $Cl_2$, and HCl can flow or be transferred between respective reactors. For example, metal chlorides generated in the non-carbothermic chlorination reactor 12 can be transferred or flow to the molten salt electrolysis reactor 14, water generated in the non-carbothermic chlorination reactor 12 can be transferred or flow to the water electrolysis reactor 16, $Cl_2$ formed in the molten salt electrolysis reactor 14 can flow to the HCl generating reactor 18, and HCl generated in the HCl generating reactor 18 can be transferred or flow to the non-carbothermic chlorination reactor 12.

Figure 3:
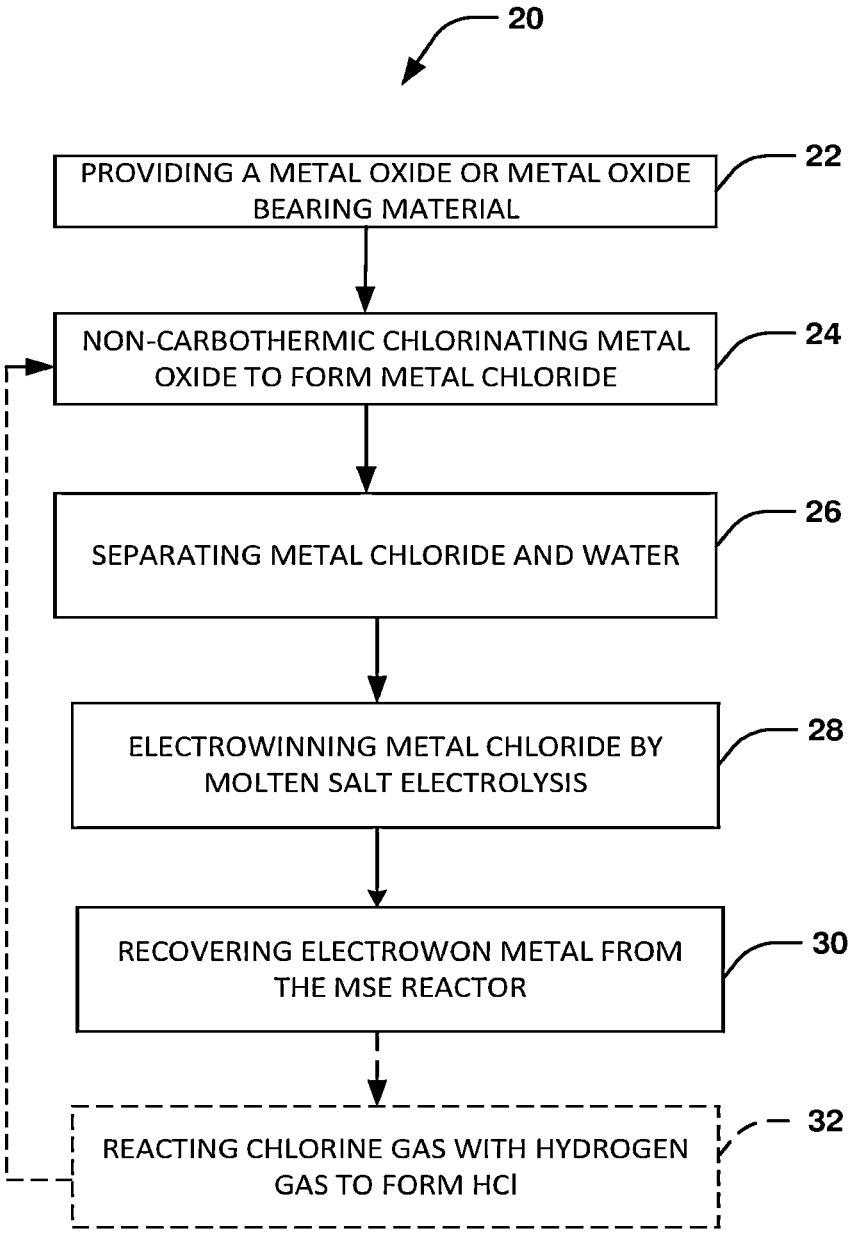
FIG. 3 illustrates a schematic flow diagram of the sustainable process in accordance with another embodiment.

FIG. 3 is a schematic flow diagram of a sustainable process 20 that employs the process and system for non-carbothermic chlorination and molten salt electrolysis described in FIGS. 1 and 2. The process starts at step 22 by providing a metal oxide or metal oxide bearing material. The metal oxide or metal oxide bearing material include metal oxide that can be processed by non-carbothermic chlorination to a metal chloride under thermodynamically favorable operating conditions (e.g., negative Gibbs free energy). The metal oxide bearing material can be an ore, a concentrate, or any other metal bearing material from which a metal oxide may be recovered. For example, the ore can include an oxide of at least one of the oxides of iron (Fe) or a rear earth metal, such as lanthanum (La), cerium (Ce), praseodymium (Pr), neodymium (Nd), samarium (Sm), europium (Eu), gadolinium (Gd), terbium (Tb), dysprosium (Dy), holmium (Ho), erbioum (Er), thulium (Tm), ytterbium (Yb), lutetium (Lu), scandium (Sc), and yttrium (Y).

The metal oxide bearing material may be processed in any manner that enables the conditions of the metal oxide bearing material, e.g., particle size, composition, and component concentration, to be used for the chosen processing method, as such conditions may affect the overall effectiveness and efficiency of processing operations. Desired composition and component concentration parameters can be achieved through a variety of chemical and/or physical processing stages, the choice of which will depend upon the operating parameters of the chosen processing scheme, equipment cost and material specifications. For example, an ore containing metal oxide bearing material may undergo comminution, flotation, blending, and/or slurry formation, as well as chemical and/or physical conditioning.

In some embodiments, the metal oxide can be a rare earth metal oxide that is obtained from a rare earth metal bearing ore containing rear earth minerals. Examples of rare earth minerals include bastnasite, monazite, loparite, apatite, xenotime, fergusonite, or eudialyte. Conventional production processes for obtaining rear earth metal oxides from deposits of rare earth metal bearing ore can include mining and milling the deposit. Alternatively, or in addition, the ore may be subject to physical beneficiation to produce an intermediate ore product. The beneficiation may performed by a combination of crushing, grinding, screening, sizing, classification, magnetic separation, electrostatic separation, flotation, or gravity separation to concentrate the metal oxide or reject a gangue component, or by other means of benefaction known in the art. Optionally, other various chemical and/or physical processes can be used to transform the rear earth bearing minerals to a more leachable rear earth metal oxide. In one example, the various chemical and/or physical processes can include a pyrometallurgical process (e.g., calcination) applied to a concentrated ore followed by hydrometallurgical separation steps. In other embodiments, rare earth metal oxides can be obtained from calcium sulphate sludges formed in the manufacture of phosphoric acid from apatite ore by leaching the sludges with dilute nitric acid and calcium nitrate.

Referring again to FIG. 3, after the metal oxide has been suitably prepared for processing, the metal oxide is transferred to the chlorination reactor and subjected to non-carbothermic chlorination at step 24 to produce a metal chloride. The non-carbothermic chlorination step can include reacting the metal oxide at room temperature (e.g., 25° C.) with a hydrochloric acid (HCl) solution at a molarity or pH effective to chlorinate the metal oxide and form an aqueous solution of the metal chloride. In some embodiments, the HCl can be provided in an aqueous solution at a concentration of about 1M to about 4M or at a pH less than 1.

By way of example, $Nd_2O_3$ can be reacted at room temperature with about 1M to 3M HCl in the non-carbothermic chlorination reactor at room temperature to convert the $Nd_2O_3$ to $NdCl_3$ followed by evaporation of the water and crystallization of the anhydrous $NdCl_3$ into a solid form. Similarly, $Fe_2O_3$ can be reacted with undiluted HCl to convert the $Fe_2O_3$ to $FeCl_3$, which can be dried before molten salt electrolysis.

Advantageously, the non-carbothermic chlorination of the metal oxide can be thermodynamically favorable such that the non-carbothermic chlorination can have a negative Gibbs free energy ($\Delta G$) at room temperature. For example, direct reaction between rare earth metal oxides including $Nd_2O_3$ and $La_2O_3$ and HCl is thermodynamically favorable given the stable nature of the rare metal earth chlorides:

$$Nd_2O_3+6HCl \rightarrow 2NdCl_3+3H_2O \quad \Delta G^0=-141 \text{ kJ}$$

$$La_2O_3+6HCl \rightarrow 2LaCl_3+3H_2O \quad \Delta G^0=-225 \text{ kJ}$$

Feasibility of the non-carbothermic reaction between $Nd_2O_3$ and HCl has substantial experimental support. Methods to prepare anhydrous $NdCl_3$ and other rare earth trichlorides via this route involve dissolving $Nd_2O_3$ in HCl, followed by evaporation, crystallization and dehydration of the $NdCl_3$ product.

At step 26, after generation of the metal chloride, water from the HCl solution and/or generated by the non-carbothermic chlorination reaction of HCl and the metal oxide can be separated from the generated metal chloride by, for example, evaporation or sublimation, to dry the metal chloride prior to molten salt electrolysis.

At step 28, the metal chloride formed by non-carbothermic chlorination and isolated or separated from water can be combined with and dissolved in a chloride based molten salt electrolyte contained in the molten salt electrolysis reactor 14 and electrowon by chloride molten salt electrolysis to produce a pure or substantially pure metal that can be extracted or recovered from the electrolysis reactor 14. As used herein, the term "electrowon" or "electrowinning" refers to electrodeposition of metals from the metal chloride that has been dissolved in the chloride based molten salt electrolyte for purification of the metal from the metal chloride. Advantageously, electrowinning of metal via chloride molten salt electrolysis offers the potential to significantly reduce electrical energy requirement and operating cost associated with metal production.

By way of example, the specific energy (in kWhr/kg-Nd) required for molten salt electrolysis is given by:

$$\text{specific energy} = \frac{1}{\varepsilon} \cdot \frac{(\Delta E_{eq} + \eta)}{(3600)} \cdot \frac{Fn}{M} \qquad [10]$$

where $\varepsilon$ is the current efficiency, $\Delta E_{eq}+\eta$ is the total cell voltage, F is the Faraday's constant, n is the number of electrons transferred, and M is the atomic weight of the metal. For conventional molten salt electrolysis of Nd using a fluoride process that employs a fluoride based molten salt electrolyte, the specific energy for Nd electrowinning is 3.35 kWhr/kg-Nd. To reduce the electrical energy consumption, overpotentials ($\eta$) must be lowered in magnitude, and current efficiency ($\varepsilon$) must be increased. The chloride molten salt electrolysis route can achieve both. While energy consumption can depend on the metal produced, the specific energy for chloride molten salt electrolysis of Nd can be about 2 to about 3 kWhr/kd-Nd, which is substantially lower than the 3.35 kWhr/kg-Nd energy consumption for conventional fluoride electrolytic processes.

In some embodiments, the electrolysis reactor can include an electrochemical cell or chamber that contains the chloride based molten salt electrolyte in which the metal chloride is dissolved and a cathode and anode to which an electric potential can be applied. An electrical potential is applied between the cathode and the anode of an electrochemical cell so that the metal chloride dissolved in the chloride base molten salt is electrolyzed such that the metal is electrodeposited on the cathode of the cell and $Cl_2$ gas is generated at the anode of the reactor In some embodiments, the electrochemical cell or chamber of the molten salt electrolysis reactor can be defined by a container or vessel fabricated from a ceramic, such as alumina, or a high-temperature corrosion-resistant metal, such as Hastelloy or Inconel. Other high-temperature corrosion-resistant materials, such as siliceous refractory material can also be used.

The anode can be non-consumable and/or dimensionally stable during electrolysis. Examples of non-consumable and/or dimensionally stable anodes include an anode of at least one of titanium or graphite optionally coated with mixed-metal oxide.

In other embodiments, the cathode includes an inert metal, such as tungsten or molybdenum.

In some embodiments, a current source can provide current effective for molten salt electrolysis of the metal chloride(s) to metal and chlorine gas. For example, the anode and cathode can be electrically connected to current source that can provide an operating current density (current applied per unit of electrode surface area) of about 50 to about 300 mA/cm$^2$.

In some embodiments, the anode and cathode are separated from one another in the electrochemical cell, such as a batch electrochemical cell. In such a configuration, the batch electrochemical cell can further include a separator or diaphragm positioned between and separating the anode and the cathode. The separator or diaphragm can inhibit redox shuttling and back reaction between metal plated on the cathode and chlorine gas generated at the anode. The separator or diaphragm can include, for example, a ceramic with a porosity of about 10% to about 60%.

The chloride based molten salt electrolyte provided in the electrochemical cell and in which the metal chloride is dissolved can include chlorides of alkaline metals and alkaline earth metals, such as chlorides of Li, Na, K, Rb, Cs, Mg, Ca, Sr, Ba either pure or in mixtures, such as eutectic mixtures.

In some embodiments, the molten salt electrolyte can include a moderate temperature chloride based molten salt electrolyte. The moderate temperature chloride based molten salt electrolyte can include a eutectic of at least two of LiCl, KCl, NaCl, CsCl, $MgCl_2$, $BaCl_2$, $SrCl_2$, or $CaCl_2$). For example, a eutectic of about 55%-60% LiCl and 45%-40% KCl can have a melting point of about 475° C.-575° C., a eutectic of 27%-98% NaCl and 73%-2% $SrCl_2$ can have a melting point of about 650° C.-800° C., a eutectic of about 66% NaCl and 34% $MgCl_2$ can have a melting point of about 750° C., a eutectic of about 85%-98% NaCl and about 15%-2% $BaCl_2$ can have a melting point of about 750° C.-800° C., a eutectic of about 30%-50% NaCl and about 70%-50% $CaCl_2$) can have a melting point of about 700° C.-750° C., a eutectic of about 50% NaCl and 50% KCl can have a melting point of about 750° C., a eutectic of about 67% KCl and 33% $CaCl_2$) can have a melting point of about 700° C., a eutectic of about 24% NaCl, 41% KCl, and 35% $BaCl_2$ can have a melting point of about 650° C., and a eutectic of about 40%-70% LiCl, 0-20% NaCl and about 25%-55% KCl can have a melting point of about 450° C.-600° C.

In some embodiments, the moderated temperature molten salt electrolysis can be conducted at a temperature of about 400° C. to about 800° C., for example, about 400° C. to about 750° C., about 400° C. to about 700° C., about 400° C. to about 650° C., about 400° C. to about 600° C., about 400° C. to about 550° C., about 400° C. to about 500° C., about 450° C. to about 800° C., about 500° C. to about 800° C., about 550° C. to about 800° C., about 600° C. to about 800° C., about 650° C. to about 800° C., or about 700° C. to about 800° C.

In other embodiments, the chloride based molten salt electrolyte can include a high temperature chloride based molten salt electrolyte. The high temperature chloride based molten salt electrolyte can include a eutectic of $SrCl_2$, $BaCl_2$, and optionally at least one of LiCl, KCl, NaCl, CsCl, $MgCl_2$, or $CaCl_2$. For example, a eutectic of about 54% KCl and 46% $BaCl_2$ can have a melting point of about 825° C. and a eutectic of about 30% $BaCl_2$ and about 70% $SrCl_2$ can have a melting point of about 847° C.

In some embodiments, the high temperature molten salt electrolysis can be conducted at a temperature of at least about 800° C., for example, at least about 850° C., at least about 900° C., at least about 950° C., at least about 1000° C., at least about 1050° C., at least about 1100° C., at least about 1150° C., at least about 1200° C., about 825° C. to about 1200° C., about 850° C. to about 1200° C., about 900° C. to about 1200° C., about 950° C. to about 1200° C., about 1000° C. to about 1200° C., about 825° C. to about 1150° C., about 825° C. to about 1100° C., about 825° C. to about 1050° C., about 825° C. to about 1000° C., about 825° C. to about 950° C., or about 825° C. to about 900° C.

One example of a molten salt electrolyte that can be used in molten salt electrolysis of the metal chloride is a melt or the binary eutectic mixture of LiCl and KCl (LiCl—KCl in the 56:44 mole percent ratio), which melts above about 350° C. Many rare earth metal chlorides including $NdCl_3$ have excellent solubility (up to 2M) in the LiCl—KCl molten salt mixture. The eutectic mixture of LiCl—KCl melts at about 400° C.-500° C. with about 0.5 to about 2 M of the metal chloride (e.g., $NdCl_3$ or $FeCl_3$) dissolved in the electrolyte. Moreover, these molten salts have excellent ionic conductivity (about 2 S/cm), offer fast diffusional transport (diffusivities of Nd species about $2\times10^{-5}$ $cm^2/s$) due to the low viscosity (about 1.5 cP) medium, have adequate electrochemical stability needed to facilitate Nd plating, and are environmentally—benign as well as low in cost. During electrolysis of $NdCl_3$ in such melts at moderate temperatures (400-500° C.), the following electrochemical reactions occur:

| | |
|---|---|
| At cathode: | $2\ NdCl_3 + 6\ e^- \rightarrow 2\ Nd(solid) + 6\ Cl^-$ |
| At anode: | $6\ Cl^- \rightarrow 3\ Cl_2(gas) + 6\ e^-$ |
| Overall reaction: | $2\ NdCl_3 \rightarrow 2\ Nd(solid) + 3\ Cl_2(gas)$ |

In some embodiments, the electrolysis can be conducted at a current density of about 50 $mA/cm^2$ to about 1 $A/cm^2$. For example, typically, at current densities in the 0.2-0.4 $A/cm^2$ range, Nd electrowon using such melts deposits as dendritic sponge on a tungsten or molybdenum cathode.

The temperature of molten salt electrolyte in the molten salt electrolysis step 40 can be adjusted in accordance with the type of molten salt electrolyte used. For example, molten salt electrolysis using a Li—KCl eutectic as the electrolyte and including about 0.5 M to about 2 M metal chloride (e.g., $NdCl_3$ or $FeCl_3$) can be performed at a temperature of about 400° C. to about 500° C. Molten salt electrolysis using a $SrCl_2$—$BaCl_2$ eutectic as the electrolyte and including about 0.5 M to about 2 M metal chloride (e.g., $NdCl_3$ or $FeCl_3$) can be performed at a temperature greater than about 800° C.

The electrochemical cell of a molten salt electrolysis reactor can include any number of cell configurations, such as a cell with a single electrolysis chamber that includes a single anode and a single cathode, a cell with multiple anodes and cathodes, a cell that includes heterogenous bipolar electrodes, and a cell with multiple chambers each, which includes anodes and cathodes separated by junctions or membranes.

Figure 4:
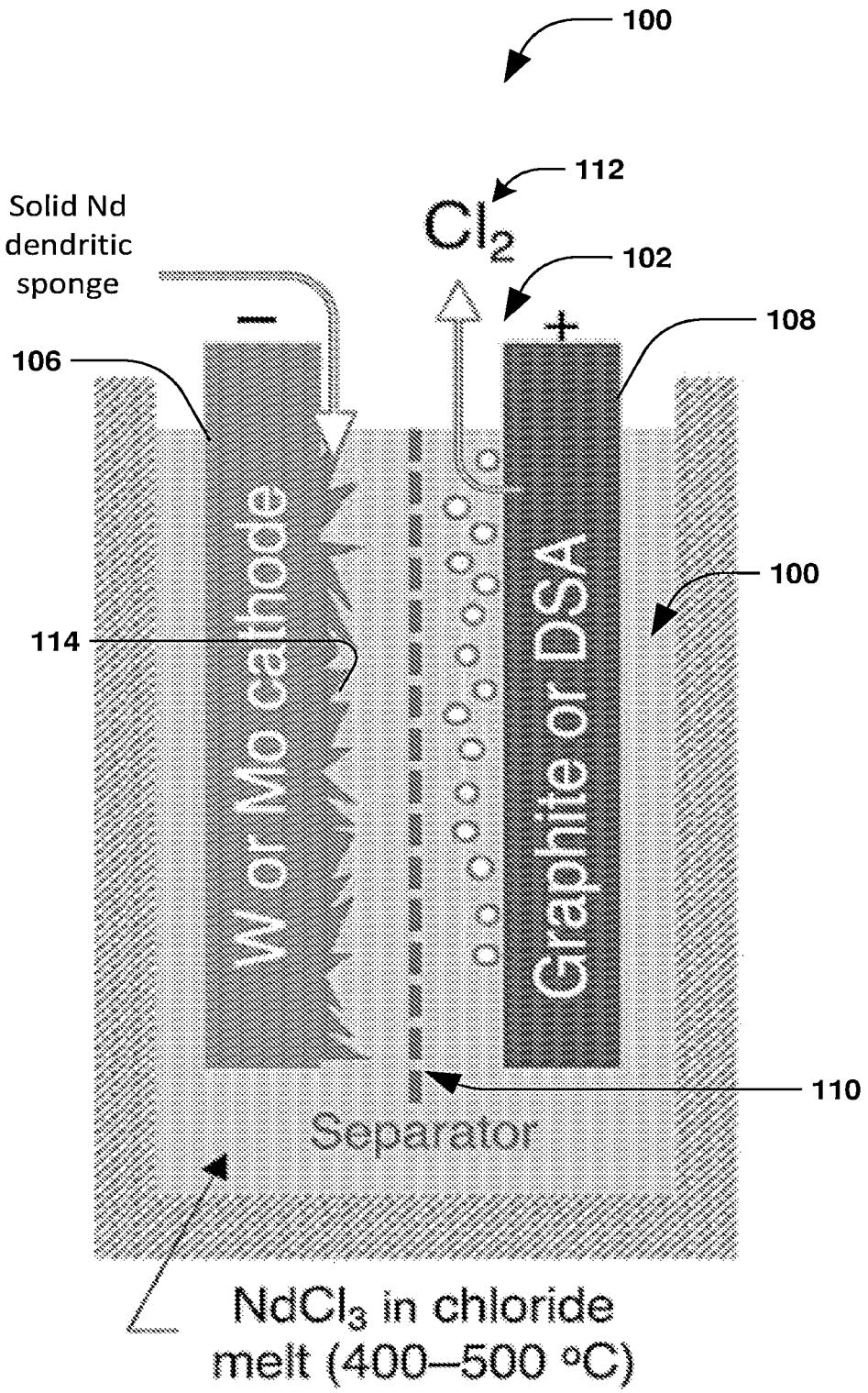
FIG. 4 illustrates a schematic diagram showing moderate temperature MSE of in batch electrochemical cell that provides dendritic Nd sponge at the cathode as shown in FIG. 5.

FIG. 4 illustrates an example of an electrochemical cell 100 suited for moderate temperature batch operation that allows recovery of solid metal electrodeposited on the cathode surface. The electrochemical cell 100 includes a electrolysis chamber 102 that contains a moderate temperature chloride based molten salt electrolyte 104, such as LiCl—KCl, NaCl—KCl or other eutectic mixtures, in which the metal chloride (e.g., $NdCl_3$ or $FeCl_3$) is dissolved as well as a vertically-aligned flat-plate cathode 106 and dimensionally stable anode 108 (e.g., graphite or Ti anode) to which an electric potential can be applied. The cathode 106 and anode 108 can be provided in other configurations, such as concentrically plated circular electrodes. The cathode 106 and anode 108 are separated from one another in the electrochemical cell 100 by a porous partition wall 110, such as separator or diaphragm 114 positioned between and separating the cathode 106 and anode 108. The separator or diaphragm 110 can inhibit redox shuttling and back reaction between metal plated on the cathode 106 and $Cl_2$ gas 112 generated at the anode 108. The separator or diaphragm 110 can include, for example, a ceramic with a porosity of about 10% to about 60%.

Figure 5:
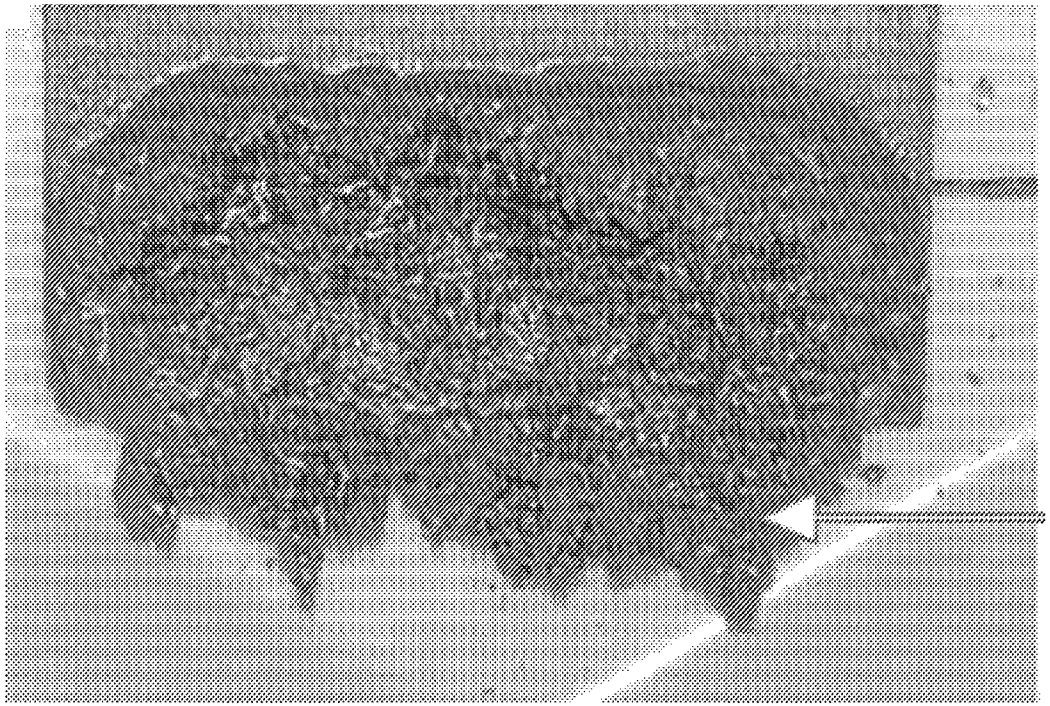
FIG. 5 illustrates an image of gram-level quantity of as deposited Nd sponge obtained in a lab scale prototype electrochemical cell. Chloride MSE was performed at 250 $mA/cm^2$ using a Mo cathode of electroactive area of about 6 $cm^2$. The molten salt electrolyte contained 2M $NdCl_3$ dissolved in LiCl—KCl eutectic melt at 475° C.

FIGS. 4 and 5 show that a molten metal chloride, such as $NdCl_3$, dissolved in the moderate temperature metal molten salt electrolyte 104, such as LiCl—KCl, NaCl—KCl or other eutectic mixtures, can be electrodeposited at moderate temperatures (e.g., about 475° C.-500° C.) as a solid dendritic metal sponge 114 (FIG. 5) on a surface of a tungsten or molybdenum cathode 106 while $Cl_2$ gas 112 evolution is facilitated on a graphite or other dimensionally stable anode 108. The deposited Nd can be recovered by scraping the Nd from the surface of the cathode 106. Referring again to FIGS. 1-3, the $Cl_2$ gas 112 generated at the anode 108 during Nd electrowinning can be recycled back into the HCl generating reactor 18 for production of HCl used in the non-carbothermic chlorination step 24.

Figure 6:
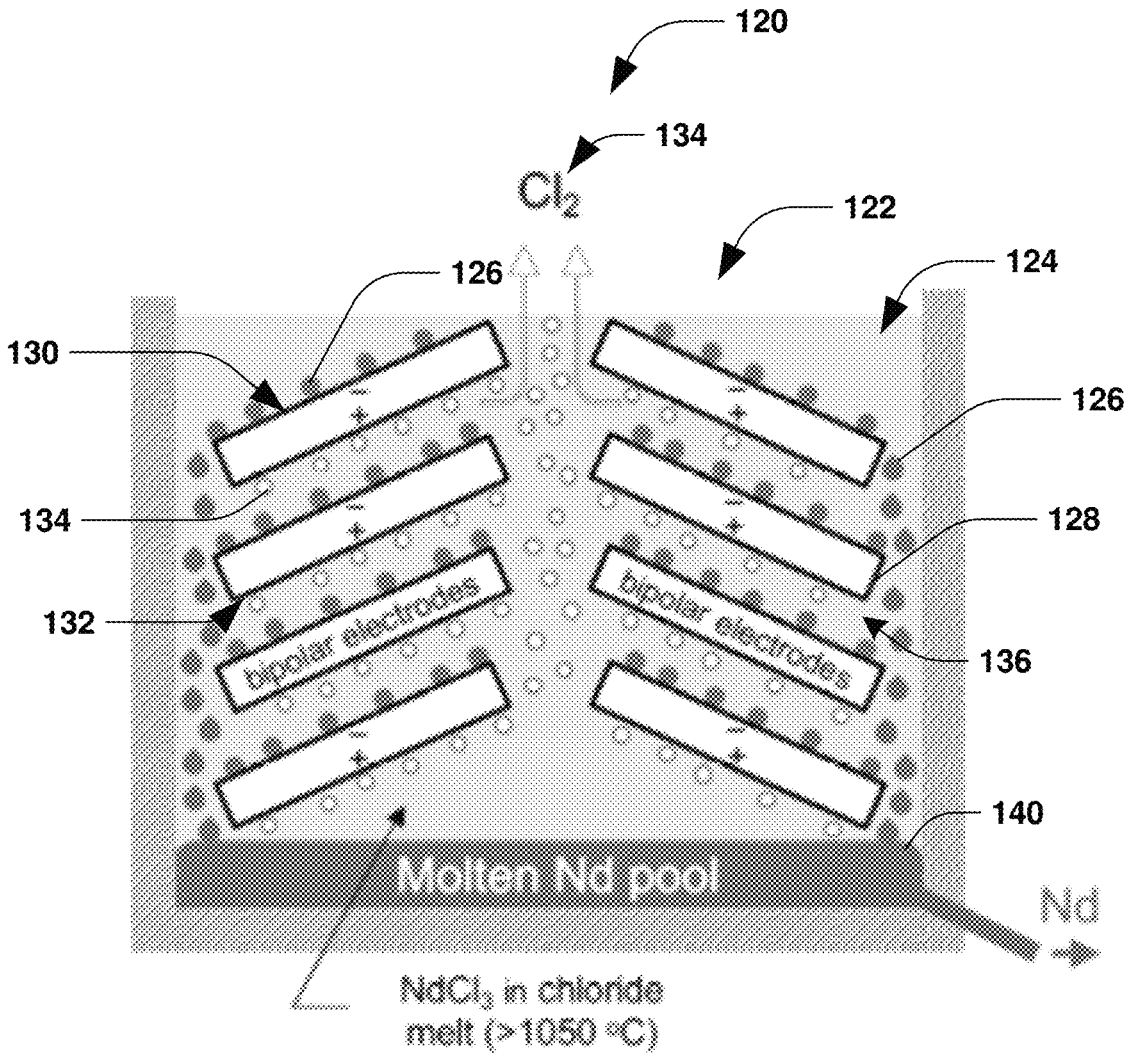
FIG. 6 illustrates a schematic diagram showing a high temperature MSE of Nd electrowinning in an electrochemical cell that includes bipolar electrodes.

FIG. 6 illustrate an example of an electrochemical cell 120 suited for higher temperature continuous molten salt electrolysis operation that allows recovery of molten metal electrodeposited on the cathode surface. The electrochemical cell 120 includes an electrolysis chamber 122 that contains a high temperature (e.g., greater than 800° C.) chloride based molten salt electrolyte 124, for example, $BaCl_2$—$SrCl_2$ or other eutectic mixtures, in which the metal chloride (e.g., $NdCl_3$ or $FeCl_3$) is dissolved. The density of the high temperature chloride based molten salt electrolyte 124 can be different (e.g., lower) than the metal 126 electrodeposited from the metal chloride so that molten electrodeposited metal 126 (e.g., Nd or Fe) can separate the chloride based molten salt electrolyte in the cell upon electrodeposition. The electrochemical cell 120 can also include a plurality of plate-like bipolar electrodes 128 arranged in two stacks. Each bipolar electrode 128 can include an upper cathode surface 130 upon which molten metal 126 from the metal chloride can be electrodeposited and a lower anode surface 132 upon which $Cl_2$ gas 134 can be generated. The plate-like bipolar electrodes 128 in each stack are arranged in super-imposed, spaced relationship defining a series of electrode spaces 136 within the cell 120. Each bipolar electrode 126 can be slanted or oblique to a bottom 138 of the electrochemical cell 120 so that molten metal 126 electrodeposited on the upper cathode surfaces 130 flows through the less dense molten salt electrolyte to an molten metal pool 140 at the bottom of the cell 120 and $Cl_2$ gas 134 generated by electrolysis at the lower anode surfaces 132 flows to a $Cl_2$ removing channel (not shown) at the top of the cell 120. The molten metal pool 140 can be fluidly connected to a sump (not shown) that removes accumulating molten metal in the molten metal pool 140 formed during molten salt electrolysis.

FIG. 6 shows that a molten metal chloride, such as $NdCl_3$, dissolved in the higher temperature metal molten salt electrolyte chloride, such as $BaCl_2$— $SrCl_2$ eutectic (mole percent ratio of about 30:70), which melts above 850° C., can be electrowon at higher temperatures (>1050° C.) to generate molten Nd metal 126. Similar to chloride-based smelting processes for Al, a stack of graphite electrodes can be configured to facilitate Nd electrowinning on the top (cathode) surface whereas $Cl_2$ gas evolves on the bottom (anode) surface. Density differences and electrolyte flow help separate the Nd product from the $Cl_2$ gas. The $Cl_2$ gas 134 generated at the anode surfaces 132 during Nd electrowinning can be recycled back into the HCl reactor 18 (FIG. 2) for production of HCl used in the non-carbothermic chlorination step. The molten Nd can accumulate in a molten Nd pool 140 at the bottom of the cell, which can be periodically or continuously removed in a batch, semi-batch, or continuous molten salt electrolysis process.

Referring again FIG. 3, following electrowinning of the metal by molten salt electrolysis, at step 30 the electrowon metal can be recovered from the molten salt electrolysis reactor. In one example for batch molten salt electrolysis performed at moderate temperatures below the melting temperature of the electrowon metal, the metal can be recovered by removing the cathode from the molten salt electrolysis reactor and scaping the electrowon metal from the cathode. In another example for semi-continuous or continuous molten salt electrolysis performed at an elevated temperatures above the melting temperature of the electrowon metal, molten metal can be recovered by draining or pumping the electrowon molten metal from the molten salt electrolysis reactor.

Optionally, $H_2O$, which is generated as a co-product of the non-carbothermic chlorination reaction 24, can be combined at step 32 with $Cl_2$ evolved in the electrolysis reaction in the molten salt electrolysis reactor to regenerate HCl. This can be achieved by first electrolyzing $H_2O$ to $H_2$ and $O_2$ in the water electrolysis reactor 16 and then reacting the $H_2$ spontaneously with $Cl_2$ in the HCl generating reactor 18. Other more directs ways of combining $H_2O$ and $Cl_2$ to re-generate HCl may also be used. Since the process 20 does not involve direct $CO_2$ generation, and assuming all electrolysis steps utilize clean electricity (no indirect emissions), the process 20 can provide Nd metal or other metals from metal oxides while being free of any $CO_2$ and perfluorocarbon (PFC) emissions. A similar route may be viable for producing other metals, such as Fe, as well as other rare earth metals, such as La and Ce.

Advantageously, the system and process described in FIGS. 1-6 offer possibilities for lowering overpotential losses and enhancing current efficiency ultimately lowering the specific electrical energy consumption and cost.

For example, the system and process recited herein can minimize ohmic overpotential losses. The ohmic overpotential $\eta_\Omega$ is related to current density (i), electrolyte conductivity (κ), and the inter-electrode separation (L) as: $\eta_\Omega=(i/\kappa)L$. In chloride molten salt electrolysis (MSE), the ratio i/κ is roughly similar to that in fluoride MSE because, although the chloride melts have a somewhat lower conductivity (1-2 $S/cm^{-1}$) than fluoride melts (3.7 $S/cm^{-1}$), the chloride melts also operate at a lower current density (0.2-0.4 $A/cm^2$) than the fluoride melts (1 $A/cm^2$). However, with use of a $Cl_2$—evolving non-consumable or dimensionally stable anode, much shorter inter-electrode spacings are possible. For example, in the ALCOA smelting process for Al electrowinning using a configuration, an inter-electrode spacing of about 0.6 cm was possible. In Nd electrowinning, this would offer a major advantage in terms of significant reduction in the ohmic overpotential and thus specific energy consumed compared to conventional fluoride MSE where L can be very large (>5 cm). The ability to maintain a fixed anode-cathode separation has other benefits too, such as improved process stability, ability to monitor and control the process during 'live' operation, and ease of scalability. These benefits are difficult to realize in the fluoride MSE route because of the consumable nature of the anode.

The system and process recited herein can also enhance current efficiency. The specific energy requirement for metal production is inversely proportional to current efficiency. In conventional fluoride MSE, current efficiency of 60-70% is routinely obtained. The low efficiency is, in large parts, due to a fundamental property of Nd in molten salts, i.e., multivalency. Since both oxidation states of Nd ($Nd^{3+}$ and $Nd^{2+}$) are stable in molten salts, current inefficiencies are introduced due to 'redox shuttling' of $Nd^{2+}$ intermediates which are generated at the cathode and oxidized back to $Nd^{3+}$ at the anode. Moreover, in fluoride MSE, the electrowon liquid Nd droplets can be oxidized due to contact with $Nd^{3+}$ via the spontaneous comproportionation reaction ($Nd+Nd^{3+} \leftrightarrows 2\ Nd^{2+}$) or due to back reaction with anode gases. Such inefficiencies can be suppressed in chloride MSE.

First, in the embodiment described in FIGS. 4 and 5, solid Nd sponge is produced. Since this sponge is attached to the cathodically polarized electrode, it's consumption via comproportionation is retarded. Second, metallic and ceramic separators or diaphragms, shown schematically in FIG. 4, are well studied in chloride MSE of metals like Ti. These diaphragms function to retard redox shuttling and avoid back reaction between plated metal and the anode gas. Chloride MSE of Ti with diaphragms has succeeded in achieving current efficiency exceeding 80%, and chloride MSE of Nd too has shown that efficiencies in the 80-90% range can be achieved albeit on liquid metal cathodes.

Finally, the Nd product formed using the chloride molten salt electrolysis system and process described herein can be substantially free of impurities. Nd metal purity exceeding 99.97% can be achieved via the chloride molten salt electrolysis process; however, additional unit operations, such as vacuum distillation may be used to purify the electrowon sponge.

From the above description, those skilled in the art will perceive improvements, changes and modifications. Such improvements, changes and modifications within the skill of the art are intended to be covered by the appended claims.

I claim:

1. A system for production of metal(s) from a metal ore containing a metal oxide, the system comprising:

a chlorination reactor containing an aqueous HCl solution, wherein the chlorination reactor is configured for non-carbothermic chlorination of the metal oxide of the metal ore with the aqueous HCl solution to metal chloride(s), wherein the metal oxide comprises an oxide of at least one of Fe or a rare-earth metal;

an electrolysis reactor including an electrochemical cell, the electrochemical cell including an anode and a cathode provided in a molten salt, wherein the anode includes graphite coated with $RuO_2$, $IrO_2$, or their combination, and the electrolysis reactor is configured for molten salt electrolysis of the metal chloride(s) to metal(s) and chlorine gas; and optionally a reactor for converting the chlorine gas generated in the electrolysis reactor to HCl, the HCl being optionally transferred to the chlorination reactor for non-carbothermic chlorination of the metal oxide.

2. The system of claim 1, further comprising a means for separating the metal(s) from the molten salt, wherein the metal(s) is in solid or liquid form.

3. The system of claim 1, wherein the chlorination reactor includes aqueous HCl converted from the generated chlorine gas at a molarity effective to convert the metal oxide to metal chloride(s).

4. The system of claim 1, wherein the metal ore comprises an oxide of at least one of Nd, Dy, Pr, La, Ce, or Fe.

5. The system of claim 1, wherein the cathode comprises an inert metal.

6. The system of claim 5, wherein the inert metal includes tungsten or molybdenum.

7. The system of claim 1, wherein the electrolysis reactor is configured for batch molten salt electrolysis and wherein the molten salt electrolysis is conducted at a temperature effective for electrodeposition of the metal(s) on the cathode.

8. The system of claim 7, wherein the molten salt includes a eutectic of at least one of LiCl, KCl, NaCl, CsCl, $MgCl_2$, $SrCl_2$, $BaCl_2$ or $CaCl_2$) and the molten salt electrolysis is conducted at a temperature of about 400° C. to about 800° C.

9. The system of claim 1, wherein the anode and cathode are separated from one another in the electrochemical cell and the electrochemical cell further includes a porous separator or diaphragm positioned between and separating the anode and cathode, the separator or diaphragm inhibiting redox shuttling and back reaction between metal(s) plated on the cathode and chlorine gas generated at the anode.

10. The system of claim 9, wherein the separator or diaphragm includes a ceramic with a porosity of about 10% to about 60%.

11. The system of claim 1, further comprising a current source for supplying current effective for molten salt electrolysis of the metal chloride(s) to metal(s) and chlorine gas.

12. The system of claim 1, wherein electrolysis is conducted at a current density of about 50 $mA/cm^2$ to about 1 $A/cm^2$.

13. The system of claim 1, wherein the ore comprises neodymium oxide.

14. The system of claim 1, producing substantially no $CO_2$ or perfluorocarbon emission.

* * * * *